United States Patent [19]

Fujiwara et al.

[11] Patent Number: 4,675,266

[45] Date of Patent: Jun. 23, 1987

[54] DRY DEVELOPING METHOD FOR LATENT IMAGE BY ONE-COMPONENT DEVELOPER

[75] Inventors: Masakatsu Fujiwara, Kasai; Yutaka Kamitani, Iakasago; Touru Yamamura, Kasai, all of Japan

[73] Assignee: Sanyo Electric Co., Ltd., Osaka, Japan

[21] Appl. No.: 839,866

[22] Filed: Mar. 14, 1986

[30] Foreign Application Priority Data

Apr. 23, 1985 [JP] Japan ..... 60-87073

[51] Int. Cl.[4] ..... G03G 13/09; G03G 13/06

[52] U.S. Cl. ..... 430/102; 430/122; 118/653; 118/657; 118/658

[58] Field of Search ..... 430/102, 122; 118/653, 118/657, 658

[56] References Cited

U.S. PATENT DOCUMENTS 4,394,429 7/1983 Hays ..... 430/102
4,397,264 8/1983 Hatch ..... 118/657 X
4,544,618 10/1985 Kopko ..... 430/102

*Primary Examiner*—Roland E. Martin
*Attorney, Agent, or Firm*—Wenderoth, Lind & Ponack

[57] ABSTRACT

This invention relates to an electrostatic developing method for a copier, a printer or the like, and more particularly to a developing method using a one-component developer. This invention can prevent inverse electrification of the developer, which is one of the main causes of producing foggy and a fringed images, by forming the developer into a very thin layer with a doctor blade and the like, can obtain a sharp and fine image by pressing a developer holder to a latent image holder and impressing an AC bias between them, can prevent the fringe image by eliminating the unnecessary developer which adheres to the latent image holder, and can realize a high-speed development without complicated apparatus.

5 Claims, 5 Drawing Figures

DRY DEVELOPING METHOD FOR LATENT IMAGE BY ONE-COMPONENT DEVELOPER

BACKGROUND OF THE INVENTION

1. Field of the Invention

The present invention relates to a method of dry developing an electrostatic latent image formed on a latent image holder for visualization of the electrostatic latent image suitable to be employed with an electronic copier, a printer and the like, and more particularly to a method of developing an electrostatic latent image with a one-component developer.

2. Description of the Prior Art

Conventionally, a method of recording an image, generally called electrostatic photography, is applied in an electronic copier, a printer and so forth. In many cases, the electrostatic photography involves a development with a two-component developer which comprises a carrier and a toner.

According to the development with a two-component developer, firstly, a latent image holder (usually in the form of a drum) is usually uniformly positively-charged (high level electrification), and optical image is focused through a lens system, or an image in dotted form is plotted through a light emission element such as and LED (light emission diode) and the like, and the image is formed by electrical treatment. A portion of the latent image holder irradiated with light or electrically treated, corresponding to the image, is discharged and is thus reduced to a low electrification potential level. On the other hand, the rest of the surface of the latent image holder remains positively-charged at the high electrification potential level. Accordingly, a pattern comprised of the portions which are at the high level and which are reduced to the low potential level by the discharge due to the above-mentioned light irradiation and so forth, results and a latent image is formed on the latent image holder. According to the normal development with a normal copier, negatively charged particles of a high electric resistance (or electric insulative toner) adhere by an electrostatic force to the portion of the latent image holder charged at the high level for providing visualization of the latent image. The visible image is transferred to a recording paper or the like, and is fixed by heating and the like for attainment of the finished image.

In the case of the foregoing development in which a toner adheres to an electrostatic latent image holder selectively and corresponding to its potential differences, a developer containing two components, that is, a toner and a carrier are generally used.

Referring to a principle of such a two-component development utilizing a two-component developer, a carrier is a particulate substance of iron, ferrite and so forth in the form of spheres, rectangular prisms and the like. On the other hand, a toner is a particulate substance of a resin containing a coloring matter. The toner and the carrier are mixed with each other and are tribioelectrified into opposite polarities. In the present form, the toner becomes negative, and the carrier positive. The toner and the carrier adhering to each other are held on the surface of a developer holder which, in a usual case, is constructed in the form of a sleeve and is provided with internal magnets for attracting the carrier and the adhering toner, and is carried toward the latent image holder. The negative-charged toner adheres by an electrostatic force to a pattern electrified as to the high potential level on the surface of the latent image holder. Thereby, a visible image (a toner image) is formed, in which the toner adheres to the portion of the latent image holder corresponding to a black colored portion of an original image such as letters, lines and so forth. Subsequently, the toner image is transferred to a recording paper and the like, and eventually is fixed permanently thereon.

It is noted that in the foregoing description, all of the above-mentioned latent image holder, carrier, and toner may have opposite polarities, respectively and correspondingly.

As understood from the above description of two-component development, a toner needs to be supplied timely, because the toner is transferred to a recording paper which is eventually discharged from the apparatus. On the other hand, the carrier is recovered for reuse without adhering to the latent image holder.

The two-component developing method has various problems as are described hereinafter.

One of the problems of the two-component developing method is that a mixing ratio of toner to carrier needs to be controlled properly all the time for achieving an acceptable developed image. More particularly, when the mixing ratio of toner to carrier is high, a phenomenon known as fog often occurs, in which a portion of an eventually obtained image to be recorded in white on a recording paper is smudged blackly, since particles of the toner adhere to the surface of a drum which should be clear, due to the insufficient triboelectrification of each particle of the toner. In contrast, when the mixing ratio of a toner to a carrier is low, an image formed on a recording paper is light in color, that is, the density is reduced.

In addition to the above-mentioned problems, a sensor for monitoring the amount of toner correctly needs to be provided for controlling the toner, and furthermore the amount of toner has to be adjusted precisely based on the sensor.

Secondly, fine particles of the toner increasingly adhere to surfaces of the particles of the carrier when the toner is repeatedly used, which reduces the ability of the carrier to be triboelectrified. Therefore, not only is a controlling of the toner supply required but also a replacement of the carrier is required.

Thirdly, for a two-component developing method, a roller for supplying a toner, a motor and a driving system for the roller, an agitator for the toner, and so forth need to be provided. The apparatus having a high number of parts is large in size and heavy in weight. From a standpoint of the above-mentioned problems such as the supply of toner, the replacement of carrier, the control of the toner and the like, it is obvious that the two-component development is expensive to maintain as it is far from maintenance-free.

In view of the foregoing problems, a so-called one-component developing method which does not require the use of a carrier had been increasingly applied for such purposes.

In a one-component developing method, an electrostatic latent image is developed with a toner singularly which essentially consists of one-component obtained by blending and pulverizing weak-magnetic powder of iron, ferrite and the like corresponding to a carrier, and a binding resin, a charge-controlling agent, and so forth. For normal development with a normal copier for copying an original in which patterns such as letters, lines and so forth are drawn in black on white background thereof, the black patterns corresponding to a high potential level portion of a latent image holder, the one-component developer is negatively electrified and adheres to the high potential level patterns (the patterns corresponding to the black colored portions of the original) for achieving a visualized positive image.

As understood from the above description, the one-component developing method, although it needs the supply of one-component developer itself, eliminates the necessities of replacement of a carrier, control of a toner such as the foregoing mixing ratio of toner and carrier which are needed for two-component developing. Therefore, the one-component developing method has such advantages in that it enables the apparatus to be nearly maintenance-free and to be small-sized and light-weight and so forth.

In the conventional two-component developing method, a magnetic brush formed on a developer holder (usually in the form of a sleeve) carrying a mixture of toner and carrier is caused to rotate and come into contact with a latent image holder for adhesion of toner to the latent image holder.

On the other hand, the following two methods for making a devloper adhere to a latent image holder are applied in most cases of one-component developing.

One of them is called a contact method (a magnetic brush method), in which a clearance is set between a developer holder and a latent image holder, a D.C. electric field is applied between them to generate a magnetic brush of the developer with magnetic fields of magnets disposed inside of the latent image holder. The tip of the magnetic brush is allowed to come into contact with the latent image holding constantly for supply of a developer to the latent image holder.

The other one is called a non-contact method (a jumpng method), in which an alternating electric field is applied between a developer holder and a latent image holder, whereby developer jumps to the latent image holder, and, in turn, the excess developer adhering to the latent image holder is caused to jump from the latent image holder to the developer holder for recovery of the excess developer. One of the important prior art magnetic brush methods, is disclosed in U.S. Pat. No. 4,121,931 (1978) by K. S. Nelson. The basic characteristics of this prior art of the magnetic brush method lie in that (1) an electroconductive developerholder is disposed adjacent to a latent image holder (in this invention, a sheet-form receptor member), (2) a magnetic one-component developer is held on the surface of the developer holder by means of magnets disposed inside of the developer holder, which causes a tip of the magnetic brush of the developer to come in contact with the surface of the latent image holder, (3) a unidirectional potential difference is established between the developer holder and the latent image holder, and (4) means are provided for giving electric charges to the developer, in other words, for electrifying the developer, a means for mixing the developer rapidly and turbulently, typically a doctor blade, is disposed adjacent to the developer holder.

According to this invention, a one-component developer, magnetically attracted against a developer holder, has a uniform thickness on the surface of the developer holder and at the same time is agitated, by means of a doctor blade mounted adjacent to the developer holder whereby the developer is provided with electric charges by the triboelectrification. Thus, the developer is electrified with magnets disposed inside of the developer holder to be formed into such a magnetic brush that the tip thereof is in contact with the latent image holder. Accordingly, the electrified developer is fed from the developer holder to the latent image holder to adhere selectively and correspondingly to potential differences of a latent image on the surface of the latent image holder, whereby visualization of the electrostatic latent image is realized. However, in the invention of U.S. Pat. No. 4,121,931, and over-shoot phenomenon often occurs in which edges of a latent image positioned in the boundary area of high and low potential level portions are electrified in such a way that the potential levels are excessively high and low, respectively and correspondingly. When an over-shoot phenomenon occurs, developer is concentrated on the edges of the latent image where the potential level is changed from a high to a low level. Therefore, a solid portion, which has a somewhat wider area to be recorded in black color, is contoured with the developer to an extremely high density. The inside of the solid portion experiences a decrease in density of developer. This is generally called an edge effect, which makes it possible to obtain a solid portion of uniform density. U.S. Pat. No. 4,121,931 describes a reverse development for visualization of a visible negative image. However, when a reverse development is carried out, the so-called foggy phenomenon often occurs. Particularly when a latent image holder made of an electroconductive organic subtance such as polyvinylcarbazol (PVC) and the like is used, the foggy phenomenon occurs so frequently that the invention is made inappropriate for practical use.

This phenomenon becomes an important problem for development with, e.g., an electrostatic graphic printer, letters, lines and so forth to be recorded in black on a white background of the eventually obtained image are formed on a latent image holder in a dotted-pattern image by means of a light emission element such as an LED and the like, out of consideration for consumed current, function-life of the light emission element and so forth. This system is different from that of a normal copier. Accordingly, for development in the above-mentioned electrostatic graphic printer, a visible negative image must be achieved by a so-called reverse development in which a positive-charged developer adheres to a low potential level portion of a latent image holder of such a type that a light-irradiated portion thereof has a low potential level.

According to the magnetic brush method, oppositely charged particles of a one-component developer tend to be produced, since particles of the one-component developer are triboelectrified with each other and with the surface of a developer holder when the one-component developer is made to have a uniform thickness on the surface of a developer holder with the doctor blade. More particularly, when particles of a one-component developer are triboelectrified with each other by agitation for the development, magnetic powder exposed on the surface of the toner (the magnetic powder corresponds to a carrier for two-component developing method) is rendered negative, and a binding resin (the binding resin corresponds to a toner for two-component developing method) positive. Actually, however, a ratio of the occupied area of the binding resin to the surface area of each particle of the developer is not constant. For example, there is a possibility of the entire surface of the magnetic powder being coated with the binding resin. Therefore, a total electric potential level of each particle of the developer becomes negative when the negative charge of the magnetic powder is larger than the positive charge of the binding resin. Contrarily, in the case when the negative charge of the magnetic powder is smaller than the positive charge of the resin, the total electric level of the particle becomes positive. Accordingly, a particle of the developer has greater possibility of being charged negative, which causes a mixed state of positive and negative-charges particles of the developer.

In the reverse development, the oppositely charged negative-charged particles of the developer as above-mentioned adhere to a high potential level pattern of a latent image holder (the pattern is eventually to be represented in white color on a recording paper). This often causes the so-called foggy phenomenon, in which a portion of an image eventually recorded in white on a recording paper is smudged black. Accordingly the invention of U.S. Pat. No. 4,121,931 is practically inappropriate for such reverse development with a printer, in which the above-mentioned foggy phenomenon occurs so frequently.

Referring particularly to the cause of why oppositely charged particles are frequently generated as above-described, the tip of a magnetic brush formed between a sleeve and a latent image holder comes in contact with the latent image holder so that the developer can be sufficiently transferred to the latent image holder. Therefore, the thickness of the developer layer on the sleeve must be maintained larger than a clearance between the developer holder and the latent image holder. In brief, such a thick layer of the developer causes particles of the developer to be triboelectrified with each other, resulting in generation of a larger amount of oppositely charged particles of the developer as above-mentioned. On the other hand, in the case of a contour of a solid portion where the potential level of an electrostatic latent image charges become extremely dense due to the foregoing over shoot phenomenon, and edge effect occurs, and furthermore, oppositely charged particles of the developer are generated in large amounts and the outside and the contour of the solid tends to be adhered to be the oppositely charged particles. Thus, the so-called fringe image is obtained eventually where the solid portion is surrounded by the toner particles spattered along the outer periphery of the contour of the solid portion.

In view of the foregoing problems in relation to the reverse development in K. S. Nelson's U.S. Pat. No. 4,121,931, various attempts to solve the problems have been proposed, as disclosed in Japanese Patent Application Laid Open No. 55-159457 (1980), No. 58-97071 (1983), No. 58-105266 (1983), No. 58-108566 (1983) and No. 60-154260 (1985).

Firstly, Japanese Patent Application Laid Open No. 55-159457 (1980) discloses an attempt to prevent a foggy image in the reverse development by using a semi-conductive or insulating magnetic developer and limiting a bias voltage VB so as to satisfy the following relationship: $|VP| < |VB| \lesssim |VP+VTR|$ wherein VP designates an electric potential (high potential) of an electrified portion (high potential level) of an electrostatic latent image, and VTH a developing start voltage. However, the test results under the foregoing condition by the present inventors reveals that a satisfactory condition can not be recognized.

Secondly, Japanese Patent Application Laid Open No. 58-97071 (1983) discloses a three-layer developer holder (a sleeve), a dielectric layer covered with the surface of the developer holder, and many fine-sized electrodes arranged on the surface of the dielectric layer and insulated from each other, for the purpose of solving the foregoing problems such as difficulties in reproducing line form and solid-form images according to the above-mentioned K. S. Nelson's invention. However, the developer holder (a sleeve) having a three-layer structure complex, and as such requires a high-precision technique for manufacture of the developing apparatus. Also such an apparatus for development is very expensive.

In the invention of Japanese Patent Application Laid Open No. 58-105266 (1983), a magnetic toner (one-component developer) is employed. A rotary magnetic brush generated on the periphery of a non-magnetic sleeve used as a developer holder, is pressed so as to come in contact with a drum used as a latent image holder. This invention is directed for using high resistant (insulating) toner (one-component toner) with ease by reducing clearance between the developer holder and the latent image holder. For achievement of this purpose, the apparatus is constructed such that the sleeve which a rotary brush of the magnetic toner is generated along with the periphery thereof contacts the drum by being pressed. According to the description in this Japanese Patent Application, the contact by pressing the sleeve with the drum causes a constant clearance between them of from 10 μm to 20 μm, due to the rotation force of the developer (one-component toner) on the sleeve and so forth.

Fourthly, Japanese Patent Application Laid Open No. 58-108566 (1983) discloses a technique for development, in which a magnetic brush of a developer formed on the surface of the developer holder is caused to contact the latent image holder, and an AC bias restricted by the following formula is applied: $|V/d| \gtrsim 0.1\,f$ wherein V designates an effective voltage (V), d a distance between a latent image holder and a developer holder (μm), and f a frequency (kHz).

This Japanese Patent Application describes that by the application of an AC bias restricted by the above formula, formation of a foggy image is prevented, and also an image formed as many successive stages is obtained. However, the test results under the foregoing conditions by the inventors of the present invention show that a satisfactory effect can not be recognized from this condition.

Fifthly, in Japanese Patent Application Laid Open No. 60-154260 (1985) by the inventors involving one of the above-said Japanese Patent Application Laid Open No. 58-108566 (1983), conditions which enable the invention of Japanese Patent Application NO. 58-108566 (1983) to be adapted for reverse development are disclosed, and are represented by the following formula: $0.2 \leqq VAC/(d \cdot f) \leqq 2.0$ wherein VAC designates an amplitude of an AC bias voltage (V), f a frequency (Hz), and d a distance between a developer holder and a latent image holder (mm). This invention discloses the same technique for development as is described in the former in which a magnetic brush of a developer (formed on the surface of the developer holder) is caused to contact the latent image holder.

In spite of th statement that the satisfaction of the above formula prevents formation of a foggy image in reverse development and enables a sharp and uniformly-colored image to be obtained, the effectiveness could not be recognized by the present inventor's test, as well as the invention of the above-mentioned Japanese Patent Application Laid Open No. 58-108566 (1983). For the purpose avoiding a foggy image formed in contact type (magnetic brush method) one-component development, non-contact type (jumping method) one-component development has been proposed, and is practically employed. One typical example of a prior art invention employing the jumping method one-component developing method is disclosed in U.S. Pat. No. 4,292,387 (1981) by J. Kanbe et al. In the above-mentioned invention, a clearance between a developer holder and a latent image holder is set so as to be larger than the thickness of a layer of developer. In other words, the clearance is so set that the surface of the developer layer on the developer holder does not contact the latent image holder. Furthermore, an AC, that is, an alternating electric field having an amplitude slightly larger than the potential difference in a latent image is applied to the clearance between the developer holder and the latent image holder, so that the developer is moved from the developer holder to the latent image holder by jumping, and, in turn, an unnecessary part of the developer transferred to the latent image holder is moved back from the latent image holder to the developer holder, which is repeated every cycle. In brief, the strength of the impressed electric field is set to correspond to the potential of a latent image on the latent image holder in such a manner that the developer is made to stay on the latent image pattern only for adhering when the developer moves back from the latent image holder to the developer holder.

U.S. Pat. No. 4,292,387 describes that such a jumping method is effective for preventing formation of the so-called foggy image, since developer transferred from the developer holder to the latent image holder and adhering to a white level portion thereof (eventually, the portion is recorded in white on a recording paper) is removed completely by moving back to the developer holder from the latent image holder by jumping.

However, this jumping method has such a great problem in that a high-speed development can not be carried out. More particularly, for high-speed development, a required amount of developer needs to be supplied to the latent image holder timely and corresponding to the high speed at which a drum used as the latent image holder an therefore a sleeve used as the developer holder are rotated. However, in this invention, an increase in the amount of developer to be transferred from the developer holder to the latent image holder every cycle of the AC bias is limited. Therefore, the frequency of the AC bias needs to be increased for high-speed development, which causes the developer to move forward and backward between the developer holder and the latent image holder at higher speed and more frequently. It is obvious that such a motion of the particles of the developer is physically restricted by its following capability. In fact, the jumping method is impractical for somewhat higher-speed development.

Furthermore, in this invention, an AC bias having an amplitude slightly larger than the potential difference of a latent image formed on the latent image holder is impressed for the above-mentioned forward and backward motion of the developer. Therefore, proper and precise control of th electric potential of the developer held on the developer holder is needed for this purpose. If the potential level of the developer is inappropriately controlled, the developer tends to scatter and adhere to a white level of the latent image holder, that is, a foggy image is formed.

Also, this tendency of the developer to scatter leads to contamination of other members of the apparatus near the developer, which lessens the function-lives thereof.

Other prior art relating to developing methods are disclosed in, e.g., Japanese Patent Publication No. 52-36414 (1977), Japanese Patent Publication No. 54-149632 (1979) and so on.

Japanese Patent Publication No. 52-36414 fdiscloses a resilient, electroconductive substrate (a developer holder) having a rough surface for pressure-development in which toner particles are caused to contact an electrostatic latent image for being transferred to the latent image holder at substantially zero relative velocity. Furthermore, in this invention, the developer is charged opposite in polarity to the latent image holder by using a plurality of triboelectrifying members while the developer is being carried. Accordingly, it is thought that this invention is directed for sufficient supply of a developer to a latent image holder.

Japanese Patent Publication No. 54-149632 discloses a developing technique in which a developer holder is pressed to contact a latent image holder, and the rotational velocity of the developer holder is controlled so as to be slightly higher than that of the latent image holder. This invention is also thought to be directed for satisfactory development by sufficiently supplying a developer to the latent image holder.

OBJECT OF THE INVENTION

Accordingly, one object of the present invention is to provide a method of developing a latent image with a one-component developer capable of preventing formation of a foggy image in reverse development often employed with a printer, and needless to say, in normal development with a normal copier.

Another object of the present invention is to provide a method of developing a latent image with a one-component developer which enables even an insulating one-component developer to be employed for development with convenience.

A further object of the present invention is to provide a method of developing a latent image with a one-component developer capable of preventing formation of a fringed image.

Yet another object of the present invention is to provide a method of developing a latent image with a one-component developer capable of avoiding contamination of members of the development apparatus surrounding the developer due to scattering of the developer.

Still another object of the present invention is to provide a method of developing a latent image with a one-component developer whereby coloration is improved particularly in color printing with a non-magnetic one-component developer.

A still further object of the present invention is to provide a latent image holder having a surface of a sleeve made of an elastic material whereby a photosensitive drum used as a latent image holder is prevented from being impaired, the durability is improved, and the quality of the images produced is preserved for a long time.

The above and further objects and features of the invention will be more fully apparent from the following detailed description taken in conjunction with the accompanying drawings.

DETAILED DESCRIPTION OF THE INVENTION

Figure 1:
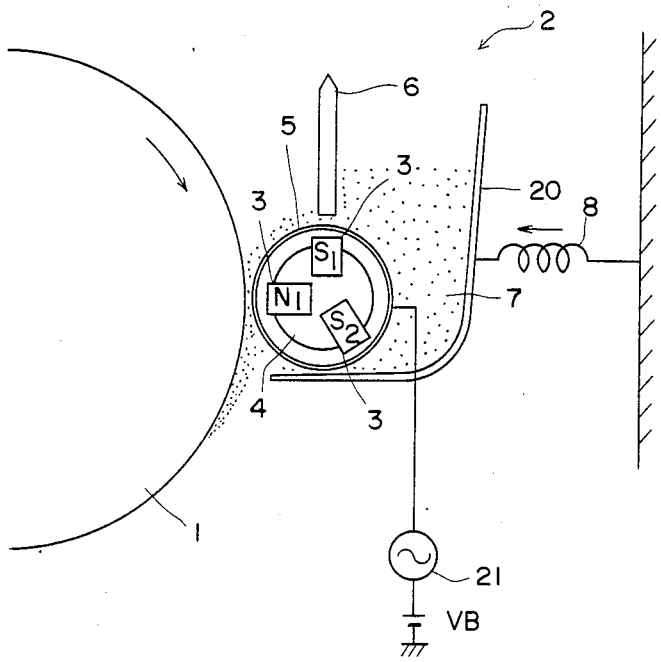
FIG. 1 is schematic sectional side elevation view of a developing apparatus embodying a one-component developing method according to the present invention.

From various examinations on the foregoing prior art, it has been surprisingly found by the inventors that the conditions as below-stated enable a sharp and clear image having a uniformly colored solid to be securely obtained without formation of foggy and fringed images in normal and reverse developments.

The first condition is that the thickness of a developer layer held on the surface of a developer holder is made as thin as possible, which prevents formation of the fringed and foggy images due to generation of oppositely charged particles as described above. More particularly, a layer of the developer needs to be made as thin as possible in order that particles of the developer can be uniformly charged with prevention of the developer particles from being triboelectrified with each other (practically, the thickness has a lower limit due to the function of coloration).

The second condition is that a developer holder (a sleeve) is pressed to a latent image holder (a sensitive drum). For efficiency of the development with a one-component toner of high resistance, that is, of insulation, the strength of an electric field impressed to particles of the developers needs to be increased by reducing as much as possible a distance between the developer holder and the latent image holder. This condition is also required for realizing the foregoing first condition. When the opposed electrodes, one being a developer holder, the other being a latent image holder, closely approach each other, the lines of electric force between the electrodes become uniform, and an over shoot level at which foggy and fringed images tend to be formed in the area where the potential level changes is reduced. Accordingly, formation of foggy and fringed images is prevented.

The third condition is that an alternating electric field (AC bias) is impressed between the developer holder (a sleeve) and that latent image holder (a sleeve) and the latent image holder (a sensitive drum). The vibration of developer in the development region (a region where the developer is in contact with the latent image holder) caused by the alternating electric field enables a sharp and definite image to be achieved. Also, this excludes adhesion of the developer to a non-imaged portion (eventually, the portion is represented in white color), that is, formation of a foggy image is prevented.

In the case where the development satisfies the foregoing three conditions, a sharp definite and uniformly colored image can be achieved without formation of foggy and fringed images by using an insulative one-component developer.

In the jumping developing method utilizing an impression of an AC bias, a developer moves from a developer holder to a latent image holder and viceversa every cycle of the AC bias. Accordingly, the jumping developing method has a difficulty in its application at high speed. In contrast, in the case where the three conditions are satisfied, a developer does not need to be caused to jump as conducted in the jumping developing method, since the one-component is pressed to a latent image holder, which enables a sufficient high speed development.

Referring to FIG. 1, there is a development apparatus of one embodiment of the present invention.

A photosensitive drum 1, used as a latent image holder in the present invention, has a peripheral surface thereof coated with a photoconductive material such as amorphous silicon or the like.

A development apparatus body 2 adjacent to the photosensitive drum 1 comprises a shaft 4 for supporting magnets and arranged so that the axis thereof is parallel to the axis to the photosensitive drum 1, a sleeve 5 rotatably mounted to the periphery of the magnet-supporting shaft 4, and a doctor blade in the casing 20 thereof.

The shaft 4 is provided with magnets 3, 3, 3 on the surface thereof which are arranged separately and parallel to the axial direction of the shaft.

The sleeve 5 is made of a non-magnetic material such as aluminum and the like.

The doctor blade 6 is mounted above the top of the sleeve 5. A clearance between the lower edge of the doctor blade 6 and the surface of the sleeve 5 can vary from 0.05 mm to 0.1 mm for a non-magnetic doctor blade 6 and from 0.1 mm to 0.2 mm for a magnetic doctor blade 6, for the purpose of achieving toner thickness between 30 μm and 100 μm.

A toner 7 which is one-component developer is filled up in the casing 20 on the opposite side of the doctor blade 6 from the drum 1. The toner 7 having an electric resistance of no less than $10^{13}\Omega$ - cm is so-called insulating magnetic toner and is attracted to the surface of the sleeve 5 by the magnets 3, 3, 3 disposed inside of the sleeve 5. A thin layer of the toner 7 is formed on the sleeve 5, the thickness of the layer being controlled by the doctor blade 6. As above-mentioned, the thickness of the thin layer of the toner 7 on the sleeve 5 is preferably between 30 μm and 100 μm.

An alternating electric field of 100 Hz to 10 kHz in frequency and 200 V (400 VPP) to 750 V (1500 VPP) in amplitude is impressed by an AC power source 21, and furthermore a DC bias voltage VB (slightly lower than the high-level voltage of a latent image) is impressed to the sleeve 5.

Hereinafter, a relation between an electric potential of the toner 7 and a distance from the lower edge of the doctor blade 6 to the surface of the sleeve 5, and a relation between both surfaces of the sleeve 5 and the photosensitive drum 1 will be described.

Conventionally in this type of apparatus, a distance from the surface of the photosensitive drum 1 to the sleeve 5 and, correspondingly, a distance from the lower edge of a non-magnetic doctor blade 6 and the surface of the sleeve 5 is 0.3 mm. In the normal development with such a conventional type of copier, a fringed image is frequently formed, though formation of a foggy image is prevented. In reverse development with a conventional printer, a foggy image is abnormally-frequently formed. Such normal and reverse developments are inappropriate for practical use because of the foregoing deficiencies.

Figure 2:
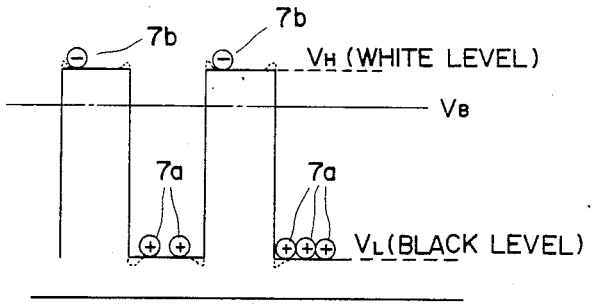
FIG. 2, is a graph indicating an electric potential level of a latent image holder (a photosensitive drum) in reverse development according to the present invention.

FIG. 2 illustrates graphically a potential level of an electrostatic latent image formed on the surface of the photosensitive drum 1 in reverse development. A high potential level (VH) portion (a white level which causes eventually a portion in white color on a recording paper) is not subjected to light irradiation. In contrast, a low potential level (VL) portion (a black level which causes eventually a portion recorded in black color on a recording paper) is generated by light irradiation. A bias voltage is designated by VB in FIG. 2.

In the case where the distance between the lower edge of the doctor blade 6 and the surface of the sleeve 5 and, correspondingly, the thickness of a layer of the toner 7 is 0.3 mm, particles of the toner 7 are triboelectrified with each other as described before, and positive particles *7a* each having a positive total potential level and negative particles *7b* each having a negative total potential level exist in a mixed state thereof.

In the reverse development in which positive particles *7a, 7a* . . . should adhere to a low potential portion (black level), negative charged-particles *7b, 7b,* generated by the foregoing triboelectrification with each other, adhere to the high potential level portion (white level) not subjected to the light-irradiation. Accordingly, a portion of an image eventually to be recorded in white color on a recording paper is represented in black color. That is, a foggy image is formed.

As illustrated by broken lines in FIG. 2, when an above-mentioned over shoot phenomenon occurs, edges of a high potential level portion and a low potential level portion of latent image where the potential level of th latent image changes are made to be higher and lower, respectively, and the positive charged-particles *7a, 7a* adhere to the edge of the lower potential level portion (black level) with extremely high density. That is, an edge effect occurs and furthermore, negative charged-particles *7b, 7b,* concentratively adhere to the edge of the higher potential level portion (white level) which is a over shoot portion, so that a fringed image is formed.

In this case, the bias potential VB may be adjusted in vain for complete elimination of the foggy image. As stated before, Japanese Patent Publication No. 55-159457 describes a relation between potential (VH) of a high potential level portion of a latent image and a bias potential VB, and discloses the optimum conditions where formation of a foggy image is prevented. However, the test results by the present inventors reveals that the above-said conditions are ineffective as described before.

As easily understood from the foregoing description, for the purpose of achieving preventing positive-charged particles of the toner 7 from being triboelectrified with each other is decreased and furthermore the particles of the toner 7 are caused to be rubbed with the sleeve 5 and the doctor blade 6 more frequently. Accordingly, it is very advantageous that a thin layer of the toner 7 is provided on the surface of the sleeve 5.

Figure 3:
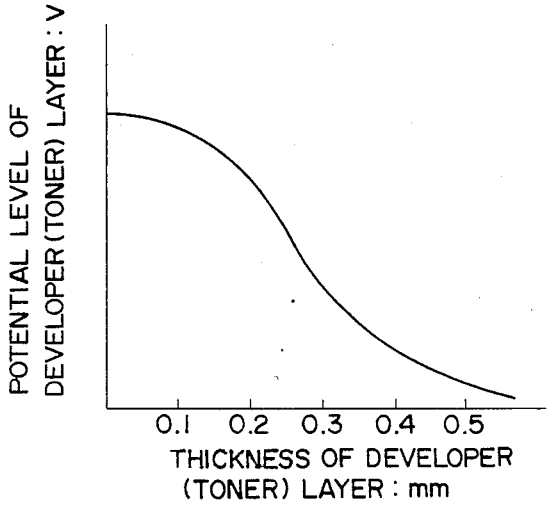
FIG. 3 is a graph illustrating a relation between the thickness and the electric potential of a layer of one-component developer on the developer holder according to the present invention.

FIG. 3, graphically illustrates a relation between the thickness of a layer of the toner 7 (axis of abscissa : mm) on the sleeve 5 and a total potential level of a layer of the toner 7 (axis of ordinate : V) which has been determined by the present inventors. As seen in the graph of FIG. 3, as the thickness of the layer of the toner 7 is made larger, the electric potential level of the toner becomes lower. In other words, the potential level of the toner 7 becomes higher as the thickness of the layer of the toner 7 decreases. Obviously, when a layer of the toner 7 as a whole is uniformly charged to be positive, the total electric potential level of the toner 7 increases. In contrast, when positive-charged and negative-charged particles exist in an equal amount, the total electric potential of the toner 7 is reduced to zero. Accordingly, it is to be understood that as the total electric potential of the layer of the toner 7 is lowered by an increase in thickness of the layer of the toner indicates that more negative-oppositely charged particles are caused to exist.

The reason is that each particle of the one-component developer is charged to be positive when rubbed with a metal, and on the other hand, the particles of the toner 7 when rubbed with each other become negative and positive almost equally in number, resulting in the reduction of the total electric potential of the layer of the toner 7.

Hereinafter, the relationship between thickness of a layer of the toner 7 and a foggy phenomenon in reverse development will be described in connection with the graph of FIG. 4 which has been determined by the present inventors.

Figure 4:
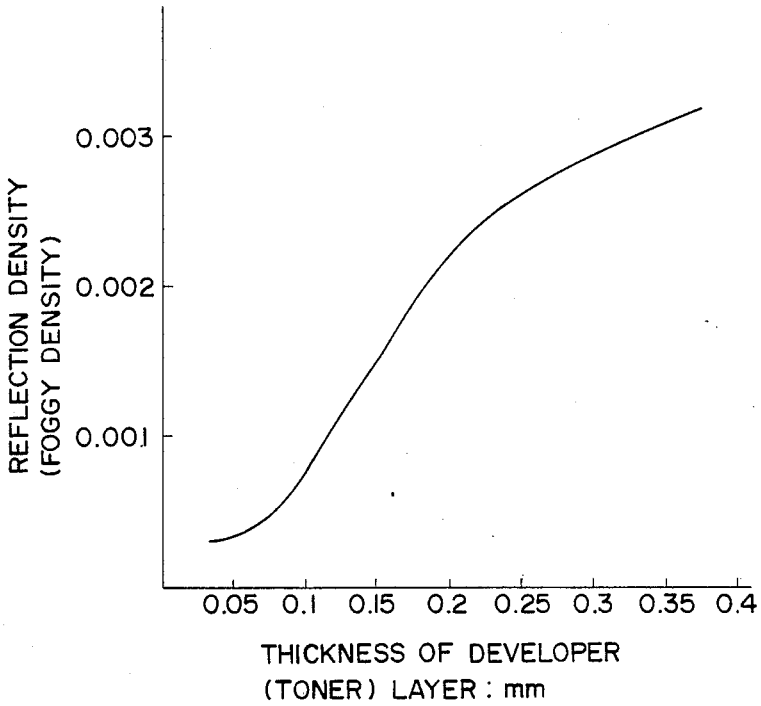
FIG. 4 is a graph illustrating a relation between the thickness of a layer of a one-component developer on the developer holder and the fog density (reflection density) according to the present invention.

The graph in FIG. 4 illustrates a relationship between a foggy density (axis of ordinate; a reflection density is measured as foggy density) and the thickness of a layer of the toner 7 (axis of abscissa; mm) of a white level portion VH (a high potential level portion here in reverse development) on the photosensitive drum 1 in reverse development, in which a distance d (mm) between the doctor blade 6 and the sleeve 5, a thickness $t \propto d$ of a layer of the toner 7 on the surface of the sleeve 5, a distance D (mm) between the sleeve 5 and the photosensitive drum 1, a bias potential (DC bias voltage) VB, and an electrification potential VH on the photosensitive drum 1 are provided with such respective values as to satisfy the following formulae:

$$(t/D)=K1>1,\ [(VH)/D]=K2,\ (VB)/(VH)=K3$$

wherein K1, K2, and K3 represent constants respectively.

As seen in the graph of FIG. 4, the fog density is lowered with a decrease in thickness of the layer of the toner 7. Since the distance D between the sleeve 5 and the photosensitive drum 1 is proportional to the thickness of the layer of the toner 7 as expressed in the above formula, the thickness t between the blade 6 and the sleeve 5 is proportional to the thickness of the layer of the toner 7.

However, from a viewpoint of working precision, it is difficult to practically set the distance D between the sleeve 5 and the photosensitive drum 1 to a value of 100 μm or less. Accordingly, in the present invention, the sleeve 5 is pressed to the photosensitive drum 1 by pushing the casing 20 of the development apparatus body 2 toward the photosensitive drum 1 with a compression spring 8, whereby the developing efficiency is enhanced because of an increase in the impressed electric field strength, the uniform density of an image is achieved without the toner being concentrated at the edges of a latent image due to the great opposed-electrodes effect, and furthermore formation of an fringed image is prevented, so that an image of high quality can be obtained.

Figure 5:
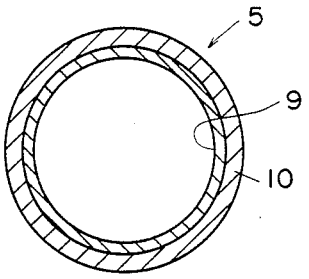
FIG. 5 is a schematic sectional view of another embodiment of the developer holder according to the present invention.

Referring to FIG. 5, there is shown another embodiment of the sleeve 50 in section.

The sleeve 50 of this embodiments comprises a metal pipe 9, and a rubber layer 10 coated on the surface thereof and having an electroconductivity that is higher than that of the toner 7. The thickness of the rubber layer 10 is preferably made as small as possible, but in consideration of practical working precision, the preferable thickness of the rubber layer 10 is from about 0.2 mm to about 0.8 mm. The surface of the rubber layer 10 is provided with fine concave recesses and convex projections each having a diameter of from about 5 μm to about 20 μm.

When the surface of the sleeve 50 is made of soft material as above-mentioned, there is no possibility of the surface of the photosensitive drum 1 being impaired. Furthermore, the transfer efficiency of the toner 7 is improved.

In the foregoing embodiments, a conventional magnetic developer is employed. When a color reproduction is desired, a non-magnetic developer is employed because the magnetic developer has poor coloring properties such as color, brightness and the like. In this case, the magnets 3, 3, 3 mounted within the sleeve 5 are removed from the apparatus shown in FIG. 1, since these magnets are used for attracting the toner 7, a one-component magnetic developer, to the surface of the sleeve 5. The non-magnetic developer needs to be electrified by supplying electric charges through the doctor blade 6, or compulsorily by a corotron and the like, since the removal of magnets 3, 3, 3 results in less triboelectrification by the non-magnetic developer and the surface of the sleeve 5.

According to the present invention, a layer of a one-component developer is made of a layer as thin as possible, a developer holder is pressed to a latent image holder, and an alternating electric field is impressed between the latent image holder and the developer holder, so the formation of foggy images and fringed images can be prevented in normal and reverse developments. From another point of view, the one-component developer on the developer holder is not caused to jump to the latent image holder but to be in contact, therewith which enables the development to be carried out at a high speed. Furthermore, the one-component developer is prevented from scattering, so that other members near the developer are scarcely smeared, and troubles of the apparatus are reduced, and the durability thereof is improved.

As this invention may be embodied in several forms without departing from the spirit of essential characteristics thereof, the present invention is therefore illustrative and not restrictive, since the scope of the invention is defined by the appended claims rather than by the description preceding them, and all changes that fall within meets and bounds of the claims, or equivalence of such meets and bounds thereof are therefore intended to be embraced by the claims.

What is claimed is:

1. A method of developing an electrostatic latent image defined on a latent image holder by transferring an electrically insulative one-component developer held on a surface of a developer holder to the latent image holder, said method comprising:

forming the one-component developer held on the surface of the developer holder as a thin layer having a thickness between approximately 30 μm and 100 μm for inhibiting self-induced triboelectrification of the one component developer;

urging the developer holder on which said thin layer is formed against the latent image holder; and impressing an alternating electric field between the developer holder on which said thin layer is formed and the latent image holder.

2. A method of developing an electrostatic latent image as set forth in claim 1, wherein said one-component developer is a magnetic developer.

3. A method of developing an electrostatic latent image as set forth in claim 1, wherein said one-component developer is a non-magnetic developer.

4. A method of developing an electrostatic latent image as set forth in claim 1, wherein the surface of said developer holder consists of a soft material.

5. A method of developing an electrostatic latent image as set forth in claim 1, wherein said one-component developer is a non-magnetic developer.

* * * * *